US005660756A

United States Patent [19]

Calmettes et al.

[11] Patent Number: 5,660,756

[45] Date of Patent: Aug. 26, 1997

[54] HIGH-VOLTAGE TRANSFORMER FOR A MICROWAVE OVEN POWER SUPPLY

[75] Inventors: Didier Calmettes; Joel Cousin; Claude Huron, all of Nevers, France

[73] Assignee: Societe Electromecanique du Nivernais Selni, Nevers, France

[21] Appl. No.: 591,376

[22] Filed: Jan. 25, 1996

[30] Foreign Application Priority Data

Feb. 17, 1995 [FR] France ..... 95 01825

[51] Int. Cl.[6] ..... H05B 6/64; H01F 27/02

[52] U.S. Cl. ..... 219/760; 336/183; 336/185

[58] Field of Search ..... 219/760, 715; 336/170, 183, 182, 185, 160, 165

[56] References Cited

U.S. PATENT DOCUMENTS

| | | | |
|---|---|---|---|
| 3,363,210 | 1/1968 | Hollyday | 336/185 |
| 3,652,968 | 3/1972 | Johnston et al. | 336/170 |
| 3,873,883 | 3/1975 | Sievers et al. | 219/760 |
| 4,216,455 | 8/1980 | Hester | 336/160 |
| 4,858,095 | 8/1989 | Narita et al. | 219/760 |
| 4,885,445 | 12/1989 | Taniguchi | 219/760 |
| 5,430,424 | 7/1995 | Sato et al. | 336/200 |

FOREIGN PATENT DOCUMENTS

| | | |
|---|---|---|
| 0294297 | 12/1988 | European Pat. Off. . |
| 0364171 | 4/1990 | European Pat. Off. . |
| 1564080 | 10/1970 | Germany . |
| 2089764 | 6/1982 | United Kingdom . |

*Primary Examiner*—Philip H. Leung

*Attorney, Agent, or Firm*—Oblon, Spivak, McClelland, Maier & Neustadt, P.C.

[57] ABSTRACT

In a high-voltage transformer for the power supply of a magnetron in a microwave oven, of the type comprising a primary coil, a high-voltage secondary coil and a heater secondary coil, the two secondary coils are superimposed by being wound on a casing that comprises three parallel flanges, two flanges for the winding of the high-voltage coil and one additional flange which, with one of the preceding flanges, enables the winding of the heater coil.

7 Claims, 2 Drawing Sheets

HIGH-VOLTAGE TRANSFORMER FOR A MICROWAVE OVEN POWER SUPPLY

BACKGROUND OF THE INVENTION

1. Field of the Invention

The invention pertains to a high-voltage transformer, specially for the power supply of a magnetron in a microwave oven.

2. Description of the Prior Art

It is known that this type of transformer has one primary coil and two secondary coils. The secondary coils are a first secondary coil, connected between the ground and the high voltage, and a second secondary coil, called a heater coil, for the starting up of the magnetron.

The document EP 0.364.171 also describes a transformer with a casing comprising plane and mutually parallel flanges, spaced out in sets of two to enable the winding of the first and second secondary coils, the two coils being superimposed along an axis perpendicular to the flanges.

The aim of the present invention is to propose a transformer of the above type, the space requirements of which are optimized as regards the arrangement of the different coils, and the manufacture of which is simple to carry out.

SUMMARY OF THE INVENTION

This aim is achieved according to the invention by means of a high-voltage transformer for the power supply of a magnetron in a microwave oven, of the type comprising a primary coil, a first high-voltage secondary coil and a second secondary coil for the heating of the magnetron, the transformer furthermore comprising a casing formed by a body and three substantially plane and mutually parallel flanges, the three flanges being spaced out in sets of two to enable the winding, around the body, firstly of the first secondary coil and secondly of the second secondary coil, the two coils being superimposed along an axis perpendicular to the flanges, wherein said body is substantially parallelepiped-shaped, the primary coil is placed in a parallel position at the side of the second secondary coil along said axis and is separated from said second coil by two magnetic shunts and the flange between the primary coil and the second secondary coil has a recess so that the magnetic shunts are fully in contact with the primary coil and the second secondary coil.

BRIEF DESCRIPTION OF THE DRAWINGS

The invention as well as its advantages will be understood more clearly from the following description, made with reference to the appended figures, of which.

MORE DETAILED DESCRIPTION

As can be seen in the different figures, the transformer according to the invention has a casing 4 to bear two coils of the transformer, a first high-voltage secondary coil which is not shown so to avoid excessively burdening the figures and a second secondary heater coil 3 for the heating of the magnetron. The connections of this coil do not appear in the figures. More specifically, the casing 4 is formed by a substantially parallelepiped-shaped body 40 and three substantially plane and mutually parallel flanges 41*a*, 41*b* and 41*c*. The two flanges 41*a* and 41*b* are spaced out by a distance H to enable the winding of the first high-voltage secondary coil along planes substantially parallel to the flanges. In the same way, the flanges 41*b* and 41*c* are also spaced out so as to enable the winding of the second secondary coil 3.

Owing to the fact that this winding comprises few turns, typically four turns, the coil can be made in a single plane parallel to the flanges, the space requirement of this coil being reduced to the thickness of the wire. To facilitate this winding, the space 2 between the two flanges 41*b* and 41*c* is preferably just enough to enable the thickness of wire to pass. During the winding, it is thus certain that the coil 3 will be positioned exactly along a plane.

When the two coils are present on the casing, they are, according to the invention, superimposed along an axis XX' perpendicular to the flanges.

Figure 1:
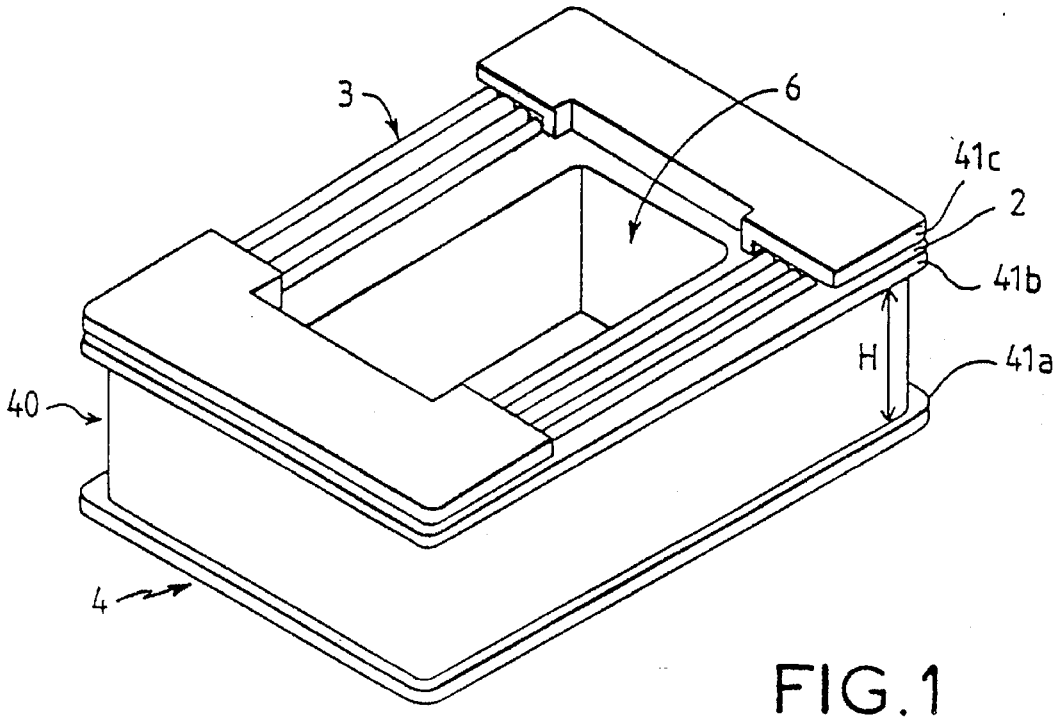
FIG. 1 shows a view in perspective of the casing bearing the two secondary coils according to an exemplary embodiment of the invention.
Figure 2A:
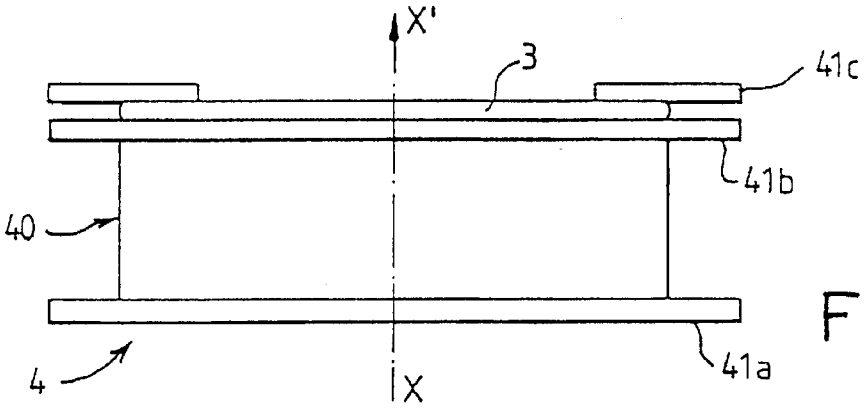
FIGS. 2*a* and 2*b* are respectively a view in elevation and a top view of the casing of FIG. 1.
Figure 2B:
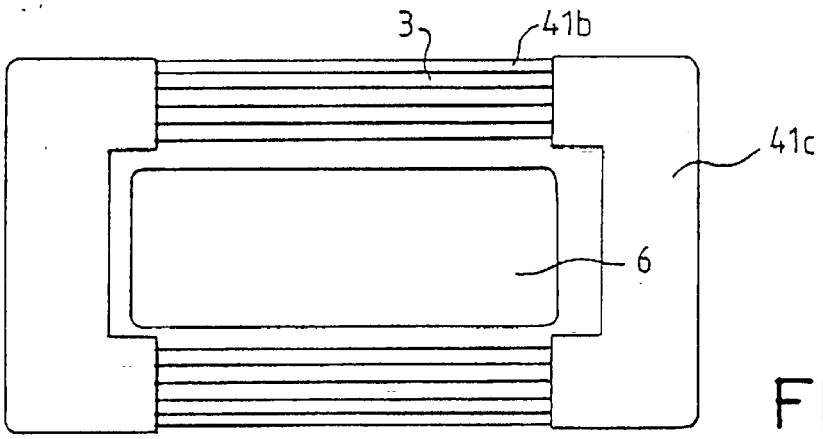
Figure 3:
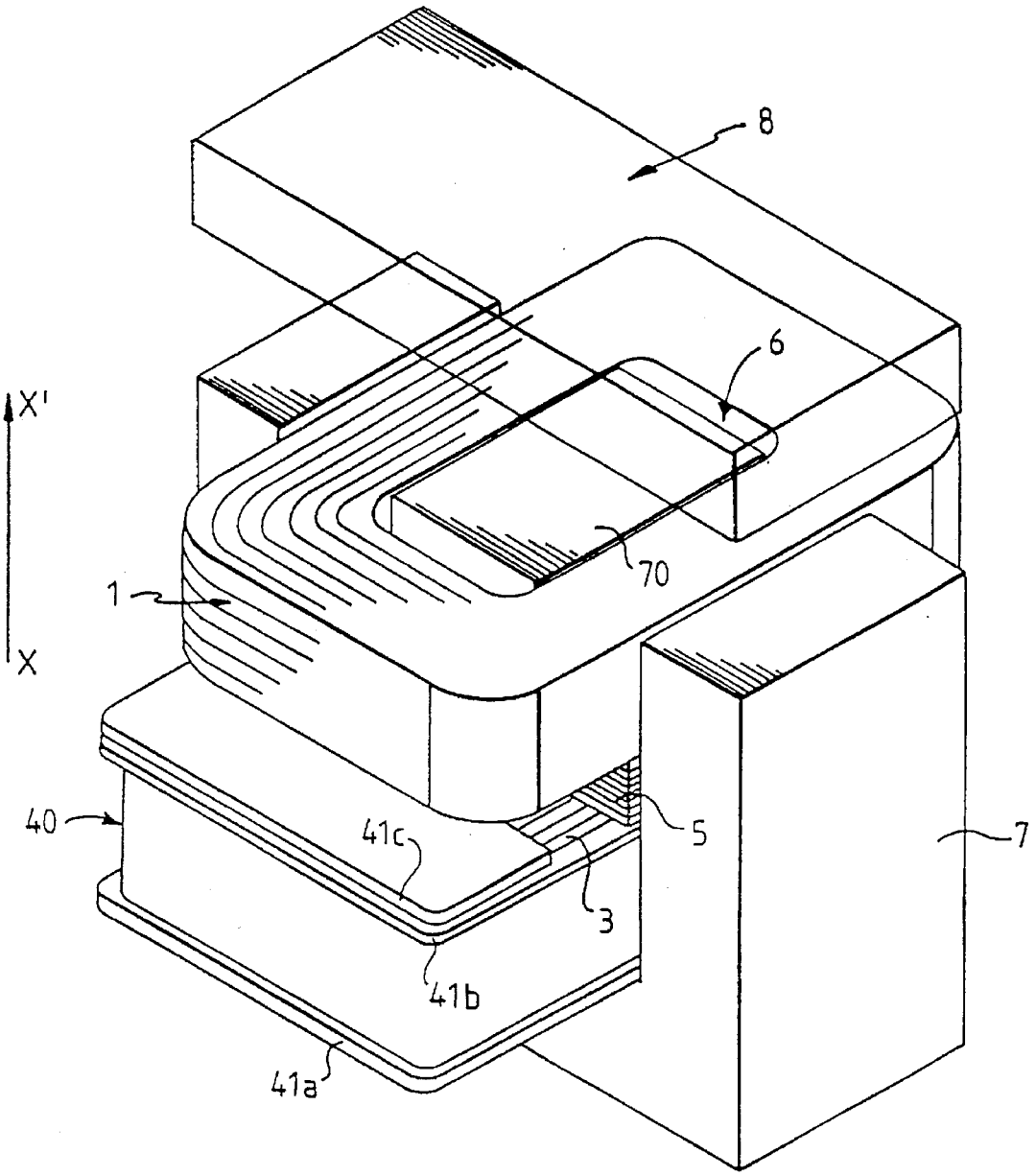
FIG. 3 shows a view in perspective of the assembling of a high-voltage transformer according to the invention.

As can be seen in FIGS. 1, 2*b* and 3, the primary coil 1 of the transformer, the body 40 of the casing 4 and the flanges 41*a* to 41*c* have a hole 6 at their center. This hole 6 is substantially centered on the axis XX' and has a shape that is, for example, rectangular. This hole 6 enables the passage of a core 70, made of magnetic material, for the creation of the magnetic fluxes. Advantageously, as shown in FIG. 3, this core 70 may form the central part of a first E-shaped part 7 of a sheet metal structure that will be used to hold all the coils.

More specifically, the casing 4, provided with its two secondary coils, and the primary coil 1 are superimposed along the axis XX' in the window of the E-shaped feature.

So as not to add to the thickness of the assembly, the flange 41*c* between the primary coil 1 and the secondary heater coil 3 advantageously has a recess as can be seen in the figures. The primary coil 1 may thus be kept at a distance from the heater coil 3 by two substantially parallelepiped-shaped magnetic shunts 5 placed in the recesses, in total contact with the primary coil and the secondary heater coil, enabling the transformer to work under saturation.

In FIG. 3, the sheet metal structure furthermore has a second I-shaped part 8 to close the window of the E once the primary coil is positioned. The two parts that form the sheet metal structure are, for example, made of magnetic steel.

The manufacture of the high-voltage transformer becomes greatly simplified if the casing is obtained in a single piece, for example by the molding of a plastic material. The material used must have high resistance under temperature, especially as regards its dielectric performance characteristics.

Once the casing is obtained, then the two secondary coils are wound. Since the primary coil is made separately, as are the two parts of the sheet metal structure and the shunts, it is then enough to assemble the different elements by stacking the casing, the shunts and the primary coil in the window and then closing the window with the second I-shaped part.

By choosing to superimpose the different coils through the use of a casing, it has been possible to optimize the filling of the window of the E-shaped structure, by reducing the space lost in this window to the minimum. Furthermore, the length of heater wire used for the heater coil has also been optimized.

What is claimed is:

1. A high-voltage transformer for the power supply of a magnetron in a microwave oven, said transformer comprising:

a primary coil;

a first high-voltage secondary coil;

a second secondary coil for heating the magnetron;

a casing formed by a body, said body being substantially parallelepiped-shaped; and three substantially plane and mutually parallel flanges, the three flanges being spaced out in sets of two to enable a winding, around the body, firstly of the first secondary coil and secondly of the second secondary coil;

the two secondary coils being superimposed along an axis perpendicular to the three flanges;

the primary coil is placed in a parallel position at the side of the second secondary coil along said axis and is separated from said second secondary coil by two magnetic shunts; and the flange between the primary coil and the second secondary coil has a recess so that the two magnetic shunts are fully in contact with the primary coil and the second secondary coil.

2. A high-voltage transformer according to claim 1, wherein the casing is obtained by a molding of a plastic material.

3. A high-voltage transformer according to claim 1, wherein the primary coil, the three flanges and the body comprise, in their middle, a hole that is substantially centered on the axis to enable a passage of a core made of magnetic material.

4. A high-voltage transformer according to claim 3, wherein the core forms a central part extending along the axis of a first E-shaped part of a sheet metal structure, in a window of which the primary, first secondary and second secondary coils are placed.

5. A high-voltage transformer according to claim 4, wherein the sheet metal structure further comprises a second I-shaped part that closes the first E-shaped part.

6. A high-voltage transformer according to claim 4, wherein the sheet metal structure is made of magnetic steel.

7. A high-voltage transformer according to claim 1, wherein the two flanges that delimit the winding of the second secondary coil are close enough to enable said winding to be done only in a plane parallel to the flanges.

* * * * *